United States Patent [19]

Andersson

[11] Patent Number: 4,781,533

[45] Date of Patent: Nov. 1, 1988

[54] CONTROL SYSTEM FOR PROPELLER WITH CONTROLLABLE PITCH

[75] Inventor: Sven-Ola Andersson, Kristinehamn, Sweden

[73] Assignee: Kamewa AB, Kristinehamn, Sweden

[21] Appl. No.: 913,595

[22] Filed: Sep. 30, 1986

[51] Int. Cl.[4] ..... B63H 3/08

[52] U.S. Cl. ..... 416/157 R; 416/48

[58] Field of Search ..... 416/48, 49, 157 R; 415/129, 130

[56] References Cited

U.S. PATENT DOCUMENTS

| | | | |
|---|---|---|---|
| 1,829,930 | 11/1931 | Hele-Shaw et al. | 416/157 R X |
| 2,188,313 | 1/1940 | Ruths et al. | 416/157 R X |
| 2,781,857 | 2/1957 | Harvey | 416/157 R |
| 3,228,480 | 1/1966 | Jörgensen | 416/169 C X |
| 3,437,150 | 4/1969 | Feroy | 416/157 R |
| 3,545,881 | 12/1970 | Naulty | 416/157 R |
| 3,640,644 | 2/1972 | Liaaen | 416/162 X |
| 3,645,644 | 2/1972 | Schwisow | 416/167 X |
| 4,028,004 | 6/1977 | Wind | 416/48 X |
| 4,563,940 | 1/1986 | Wührer | 416/157 R X |

FOREIGN PATENT DOCUMENTS

| | | | |
|---|---|---|---|
| 890187 | 1/1972 | Canada | 416/157 R |
| 946590 | 8/1956 | Fed. Rep. of Germany | 416/157 R |
| 1083482 | 1/1955 | France | 416/48 |
| 8204351 | 5/1984 | Netherlands | 416/157 R |
| 851694 | 10/1960 | United Kingdom | 416/27 |

OTHER PUBLICATIONS

Kamewa, C. P., Propeller, Main Principle, *Hansi Kobes AB?Nermans*, Printed in Sweden 84.04.1.

*Primary Examiner*—Everette A. Powell, Jr.

*Attorney, Agent, or Firm*—Browdy and Neimark

[57] ABSTRACT

An actuating system for a controllable pitch propeller comprises a hydraulic servomotor arranged in the propeller hub and being connected mechanically to the propeller blades. Pressure medium is delivered to the servomotor, under the control of a control valve, from a pressure-medium source, which is connected to a stationary pressure-medium chamber which embraces a rotatable shaft connected to the propeller and which is sealed against the outer surface of the shaft and communicates, via a radial pressure-medium channel in the shaft, with an axial pressure-medium channel located in the shaft and extending to the hydraulic servomotor. The system further comprises an additional stationary pressure-medium chamber which embraces the shaft and seals against the outer surface thereof and which, via an additional radial pressure-medium channel in the shaft communicates with the axial pressure-medium channel in the shaft. The system also comprises an additional pressure-medium source, and each of the two pressure-medium sources can be connected alternatively to any one of the two pressure-medium chambers, whereby the actuating system can be operated in a substantially unchanged manner irrespective of faults in any of the two pressure-medium sources and irrespective of faults in any of the high-pressure seals of the two pressure-medium chambers.

7 Claims, 2 Drawing Sheets

Fig. 1
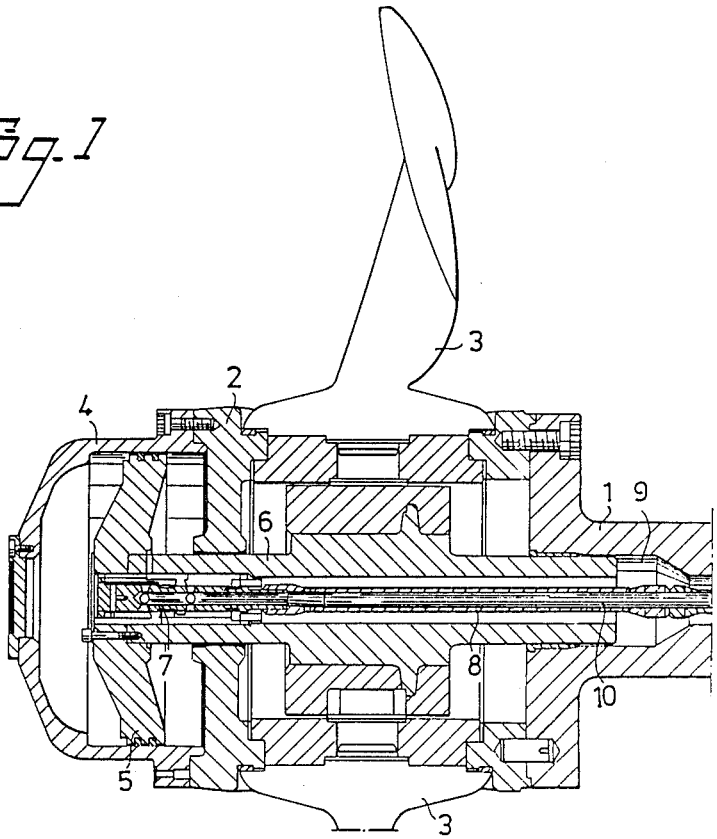
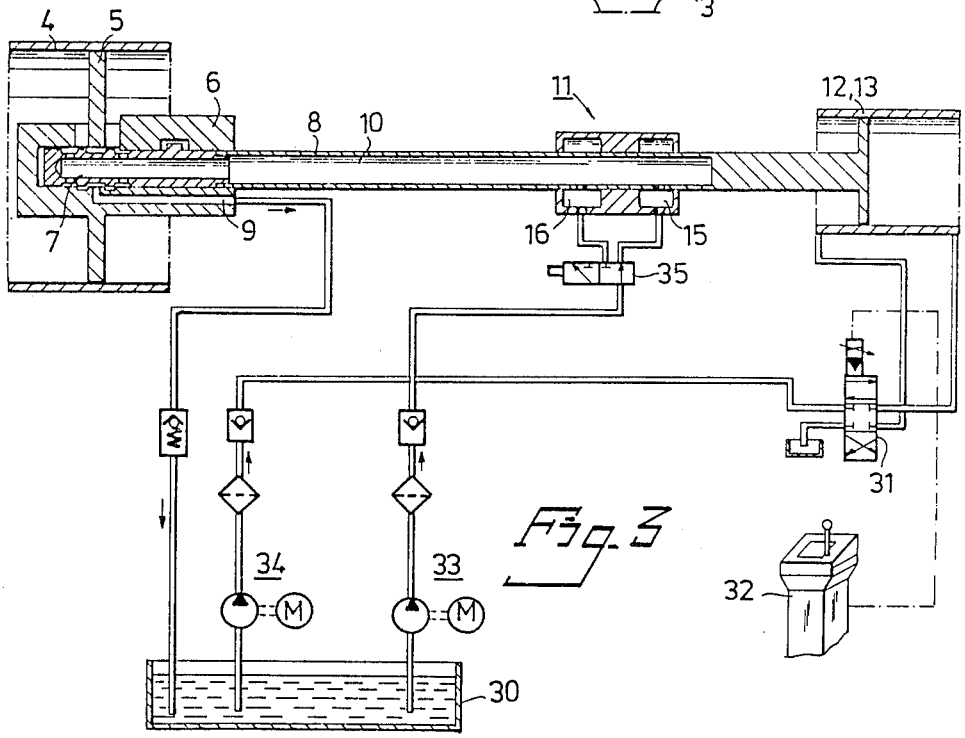
Fig. 3

CONTROL SYSTEM FOR PROPELLER WITH CONTROLLABLE PITCH

BACKGROUND OF THE INVENTION

1. Field of the Invention

The present invention relates to an actuating system for propellers with variable or controllable pitch.

2. The Prior Art

Marine propellers with controllable pitch have long been known to the art and are used to a significant extent both as forward propulsion propellers and steering propellers, and in so-called thrusters. In the majority of cases the pitch of such propellers is controlled and varied by means of an hydraulic actuating system comprising an hydraulic master servomotor which is connected mechanically to the propeller blades and is effective for altering and controlling the pitch of the blades. The master servomotor can be placed at various locations in the system, although in the majority of cases it is placed in the propeller hub, the servomotor usually comprising a hydraulic piston-cylinder device, the piston of which is connected to the propeller blades for adjusting the pitch angles thereof. Pressure medium is delivered to the master servomotor from a source of pressure medium incorporated in the actuating system, under the control of a main control valve. The main control valve is also often installed in the propeller hub. The valve is actuated by means of a valve rod which extends through an axial bore in the propeller drive shaft and is connected to an auxiliary servomotor, located inside the vessel to which the marine propeller is fitted, such that the valve rod, and therewith the main control valve, can be actuated by means of the auxiliary servomotor. The supply of pressure medium to the master servomotor and to the main control valve in the propeller hub is effected through a so-called pressure-oil box or oil distribution box connected to the pressure medium source and embracing the propeller drive shaft, or a shaft connected thereto, inside the vessel. The oil distribution box incorporates a stationary pressure-medium chamber which is connected to the source of pressure medium and which surrounds the rotatable propeller shaft and is sealed against the outer cylindrical surface thereof. The pressure-medium chamber connects, via a radial channel in the propeller shaft, with a channel which extends axially within the shaft and out into the propeller hub, where said channel communicates with the master servomotor via the master servomotor main control valve, which is also located in the hub. The axial channel in the propeller shaft is often placed within the valve rod of the main control valve, in which case the valve rod has the form of a hollow tube. The auxiliary servomotor located inside the vessel is actuated by means of an auxiliary control valve, which is normally operated electrically, but which may also be pneumatically, hydraulically or even mechanically operated. The auxiliary servomotor control valve is normally actuated by means of a lever positioned on the bridge of the vessel, whereby the pitch of the propeller blades can be altered and set by an appropriate activation of the lever. The auxiliary servomotor and its control valve are normally positioned adjacent to or on the pressure-oil box. The main control valve for controlling the master servomotor located in the propeller hub need not necessarily be located within the propeller hub, however, but may be placed at some location inside the vessel, for example connected between the pressure-medium source and the pressure-oil box. In this case no auxiliary servomotor is needed for activating the main control valve, which consequently obviates the need for an auxiliary control valve for such an auxiliary servomotor, it being possible in this case to control the main control valve directly through the lever located on the bridge of the vessel. The pressure-oil box may also be placed within or on the outside of a gear mechanism connected to the propeller drive shaft, when such a mechanism is provided.

An hydraulic actuating system of the kind described above for altering the pitch of a controllable pitch marine propeller is prone to various faults which are liable to render the system non-functionable, either in part or in total. It must be possible in such cases of system malfunction, however, to influence the blade pitch, at least to some extent, and hence a number of back-up or emergency systems are normally installed. For example, there is normally provided a back-up communication between the bridge or a control room and the auxiliary servomotor control valve or a back-up therefor, which can be used in the event of an interruption in the normal connections between the bridge and the auxiliary servomotor control valve located in the vicinity of the oil distribution box. Such back-up systems often also include press-buttons arranged on or close to the oil distribution box, these buttons being usable for actuating or controlling the system. In order for such back-up systems to function satisfactorily, however, it is necessary for the hydraulic system as a whole and for the mechanical components of both the propeller and the oil distribution box to be free from faults. Consequently, it is standard practice to provide controllable pitch propellers with some form of emergency device for use in the event of a faulty hydraulic system. Such an emergency device may comprise, for example, an arrangement of springs in the propeller hub, these springs being operative in urging the propeller blades to a position corresponding to maximum or full pitch, when the propeller shaft is non-rotating, whereafter the propeller can be driven with this maximum pitch at a reduced speed. In another alternative emergency arrangement, the valve rod of the main control valve serving the master servomotor and housed in the propeller hub is arranged in a manner which enables it to be connected mechanically to the piston rod of the main servomotor, whereby with suitable arrangement the piston rod can be moved, through the intermediary of the valve rod, to a position corresponding to full or maximum pitch, whereafter the propeller can be driven at this pitch at a reduced speed. All known emergency actuating systems of this kind, however, are encumbered with the disadvantage of having limited mechanical strength and of being incapable of setting the blade pitch to more than one single, given position, this position normally being a full-ahead position.

It is often desirable, however, to be able to set the propeller blades to any pitch whatsoever with the aid of an emergency actuating or control system, although this has not been possible with the actuating systems known hitherto. It is also desirable to be able to drive the propeller at any speed whatsoever when setting the pitch by means of an emergency actuating system.

SUMMARY OF THE INVENTION

Consequently an object of the present invention is to provide an actuating system for controllable pitch propellers of the aforesaid kind which will enable the propellers to be set to any desired pitch, even when the main hydraulic system malfunctions.

This object is achieved by means of an actuating system constructed in accordance with the invention as defined in the following claims.

BRIEF DESCRIPTION OF THE DRAWINGS

The invention will now be described in more detail with reference to an examplifying embodiment thereof illustrated in the accompanying drawings, in which FIG. 1 is a schematic axial sectional view of the propeller itself and of the actuating system components located in the propeller hub and effective for altering and controlling the propeller pitch;

FIG. 3 is a simplified illustration of a hydraulic circuit for the actuating system.

DETAILED DESCRIPTION OF THE PRESENT INVENTION

Figure 2:
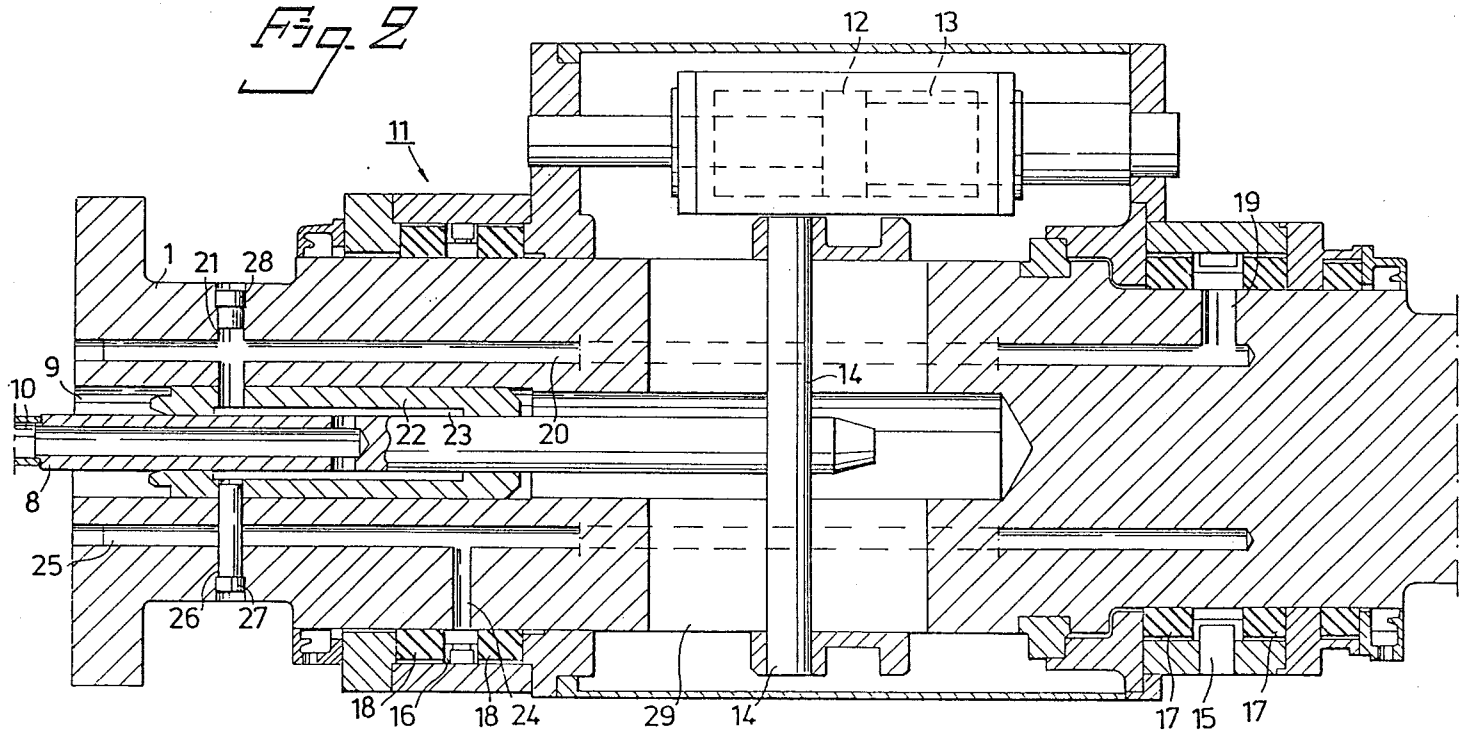
FIG. 2 is a simplified axial sectional view of the oil distribution box and that part of a propeller-connected shaft embraced by the box.

FIG. 1 illustrates a propeller comprising a propeller shaft 1 which is only partially shown and to which there is attached a propeller hub 2 in which the propeller blades 3 are mounted for rotation about their mounting axes. For the purpose of changing the pitch of the propeller blades 3 there is provided a master servomotor comprising a cylinder 4 and a piston 5 arranged for axial movement in the cylinder and having a piston rod 6 which is connected in a known manner to the propeller blades 3, such that axial displacement of the piston 5 results in a commensurate change in the pitch angle of the propeller blades. The supply of pressure medium to the hydrauliccylinder 4, on both sides of the piston 5, is controlled by means of a main control valve which is arranged within the piston 5 and the piston rod 6 and which comprises a valve slide 7 capable of being actuated by means of a valve rod 8 which extends axially through the piston rod 6 and through an axial bore 9 provided in the propeller shaft 1. The pressure medium is delivered to the control valve through a pressure-medium channel 10 extending axially within the tubular valve rod 8, and is recycled through the axial bores in the piston rod 6 and the propeller shaft 1 on the outside of the valve rod 8. Control of the master servomotor 4, 5, and therewith of the pitch of the propeller blades 3, is thus effected by axial displacement of the valve slide 7 with the aid of the valve rod 8.

Actuation of the valve rod 8 is effected with the aid of an auxiliary servomotor, which is arranged adjacent the pressure-oil box or oil distribution box generally identified by reference number 11 in FIG. 2. The illustrated oil distribution box 11 is stationarily arranged and embraces the rotatable propeller shaft 1. It should be noted in this regard that although the shaft in FIG. 2 embraced by the oil distribution box 11 is identified with the same reference numeral 1 as the propeller shaft in FIG. 1, this does not necessarily mean that the two shafts are identical. For example, the shaft embraced by the oil-distribution box 11 may be an intermediate shaft connected to the propeller shaft, or may constitute a shaft incorporated in a gear transmission, when such a transmission is provided, or some other shaft connected to the propeller shaft and extending coaxially therewith. For the sake of simplicity, however, the shaft embraced by the oil distribution box 11 will at times be referred to hereinafter as the propeller shaft. In the illustrated embodiment the aforesaid oil distribution box 11 contains the aforementioned auxiliary servomotor, which in this case comprises a stationary piston 12 arranged within an axially movable cylinder 13. The cylinder 13 is connected mechanically in a suitable known manner to a transverse pin 14 attached to the end of the valve rod 8, so that axial movement of the cylinder 13 results in corresponding axial movement of the valve rod 8. Actuation of the auxiliary servomotor 12, 13, and therewith axial displacement of the valve rod 8, is effected by means of a control valve intended for controlling the supply of pressure medium to the cylinder 13 on both sides of the piston 12, this control valve not being shown in FIG. 2 but being described hereinafter with reference to FIG. 3.

One important function of the oil distribution box 11 is to serve as a connection for the pressure-medium source of the actuating system for supply of pressure medium to the master servomotor 4, 5 in the propeller hub. To this end, the oil distribution box 11 is provided with two annular pressure-medium chambers 15 and 16 respectively which surround the shaft 1 and which are sealed against the outer cylindrical surface thereof by means of high pressure seals 17 and 18 respectively. These pressure-medium chambers 15 and 16 can be connected to a pressure-medium source, in a manner not illustrated in FIG. 2, but described hereinafter with reference to FIG. 3. Each of the pressure-medium chambers 15 and 16 may be placed in communication with the pressure-medium channel 10 in the valve rod 8. To this end, a channel 19 extends radially from the pressure-medium chamber 15 into an axially extending channel 20 in the shaft 1, which channel 20 leads to a radially extending channel 21 located in said shaft 1 and distal from the channel 19 and in a bearing sleeve 22 for the valve rod 8. The radial channel 21 discharges into a space 23 located inwardly of the bearing sleeve 22, this space communicating with the axial channel 10 in the valve rod 8. Correspondingly, a channel 24 extends radially from the other pressure-medium chamber 16, and communicates with a channel 25 extending in the shaft 1 axially from said channel 24 to a radial channel 26 in the shaft 1 and the bearing sleeve 22, this latter radial channel 26 also discharging into the space 23. In the illustrated embodiment, sealing plugs can be screwed into the radial channels 21 and 26, so as to seal-off respective radial channels 21, 26 in relation to the associated axial channel 20 and 25 respectively. FIG. 2 shows one such, relatively long screw plug 27 inserted into the channel 26, while a short plug 28 is inserted in the radial channel 21 solely to seal-off its outer end. Thus, in the illustrated case solely the pressure-medium chamber 15 communicates with the channel 10 in the valve rod 8 for delivery of pressure medium to the master servomotor 4, 5 in the propeller hub, while, on the other hand the other pressure-medium chamber 16 has no such connection with the channel 10 in the valve rod 8. Should the high-pressure seal 17 for the pressure-medium chamber 15 become faulty, the other pressure-medium chamber 16 can be used instead to supply pressure medium to the master servomotor 4, 5 in the propeller hub, by replacing the long plug 27 in the channel 26 with a short plug, and replacing the short plug 28 in the channel 21 with a long plug, so that the pressure-medium chamber 16 is placed in communication with the channel 10 in the valve rod 8, while the connection between the channel 10 and the pressure-medium chamber 15 is closed. In this way it is possible to use the actuating system for setting the propeller pitch in a substantially unchanged manner, even should the high-pressure seals of the pressure-medium chamber normally used be faulty.

The pressure medium returned from the master servomotor 4, 5 in the propeller hub is led through the bore 9 in the shaft 1 (see also FIG. 1) on the outside of the valve rod 8 to the space 29 in the oil distribution box 11, from which space the pressure medium is led to the tank of the hydraulic system, this tank not being shown in FIG. 2. The space 29 in the oil-distribution box is sealed against the outer cylindrical surface of the shaft 1 by means of low pressure seals which are not likely to become faulty and which may also be allowed to leak without jeopardizing the function of the actuating system.

FIG. 3 illustrates a simplified hydraulic circuit for the actuating system, FIG. 3 illustrates the pitch-setting master servomotor comprising the cylinder 4 and the piston 5 arranged in the propeller hub, and also the valve slide 7 arranged in the piston rod 6 of the piston 5, said valve slide being shown together with its valve rod 8 extending through the shaft 1 and incorporating an internal channel 10 through which pressure medium is delivered to the servomotor 4, 5. The pressure medium is recycled from the servomotor 4,5 through the channel 9 (see FIGS. 1 and 2) to the tank 30 of the hydraulic system. Also illustrated schematically in FIG. 3 is the auxiliary servomotor 12,13 for actuating the valve slide 7 via the valve rod 8, and also the oil distribution box 11 together with its two pressure-medium chambers 15, 16 for supply of pressure medium to the channel 10 in the valve rod 8. As mentioned in the foregoing discussion, displacement of the valve slide 7, and therewith actuation of the master servomotor, 4, 5, is effected with the aid of the auxiliary servomotor 12, 13. As illustrated by way of example in FIG. 3, the auxiliary servomotor 12, 13 can be actuated by means of a control valve 31, which in the illustrated embodiment is electrically operated by means of a lever provided in a control console 32 arranged on the bridge of the vessel. The hydraulic system also incorporates two alternative pressure-medium sources generally designated 33 and 34, respectively. The pressure-medium source used on any particular occasion can be connected with either the pressure-medium chamber 15 or the pressure-medium chamber 16 in the oil distribution box 11, by means of a switchable valve arrangement 35 or in some other suitable way. Thus, the system includes an ordinary pressure-medium source, for example the pressure-medium source 33, and also a pressure-medium source 34 which can be used as a reserve source should the ordinary pressure-medium source 33 become faulty.

Since the two pressure-medium sources 33 and 34 can be connected, by means of the valve arrangement 35 or some other suitable means, with either the one pressure-medium chamber 15 or the other pressure-medium chamber 16 in the oil distribution box 11, the actuating system can be caused to function in a substantially unchanged manner irrespective of which of the pressure-medium sources 33 and 34 should become faulty, and also irrespective of which of the high-pressure seals for the pressure chambers 15 and 16 should malfunction. Consequently, the propeller blades can be set to any pitch whatsoever irrespective of the type of fault occurring, provided that the propeller itself and the system components located in the propeller hub are intact. If desired, the pressure-medium source used as a back-up source can have a smaller volumetric capacity than the pressure-medium source normally used, and may also have a separate tank. Such an arrangement, however, has the disadvantage that when using the back-up pressure source the propeller pitch can only be changed slowly and, when the volumetric capacity of said source is very small, only when the propeller shaft is stationary. In general, however, this drawback is not too serious.

In the event of a fracture or disconnection in the connection between the console 32 on the bridge of the vessel and the auxiliary servomotor control valve 31 positioned in the vicinity of the oil distribution box 11, there is provided the previously mentioned reserve connections over which the valve 31 can be actuated from the bridge or from a control room, or the valve 31 or a back-up valve serving as a reserve for said valve 31 can be actuated by means of pressure buttons located directly on the oil distribution box 11. To safeguard against malfunctioning of the auxiliary servomotor 12, 13 there may be provided an emergency servomotor by means of which the valve rod 8, and therewith the valve slide 7 in the main control valve arranged in the propeller hub, can be actuated. Alternatively, mechanical means may be provided by means of which the valve rod 8, and therewith the valve slide 7, can be actuated from within the watercraft. As will be understood from the foregoing, all of the aforesaid emergency actuating devices are capable of setting the propeller to any desired pitch.

It will be understood that the described and illustrated actuating system according to the invention can be modified in various ways. For example, the oil distribution box 11 and the auxiliary servomotor 12, 13 may be constructed in a number of different ways. In addition, the pressure-medium channels in the shaft extending between the two pressure-medium chambers of the oil distribution box and the axial channel 10 in the valve rod 8 may be positioned in a number of different ways. The devices for closing the connection from either one or the other of the two pressure-medium chambers to the pressure-medium channel 10 of the valve rod 8 may also be of a kind different to that described. For example, the plugs 27, 28 of the illustrated and describe embodiment may be replaced with non-return valves. It is also possible to this end to use a piston which is axially displaceable within the pressure medium channel 10 of the valve rod 8 and which can be set to a position in which it closes a pressure-medium channel from one or the other of the aforesaid pressure-medium chambers in the oil distribution box. As previously mentioned, the main control valve for the master servomotor 4, 5 need not necessarily be arranged within the propeller hub, as in the case of the illustrated and described embodiment, in which the main control valve is formed by the valve slide 7. Instead, the master servomotor control valve may be arranged inside the vessel externally of the propeller shaft, i.e. in principle between the pressure-medium connections to the oil distribution box 11 and the pressure-medium source used at that particular time. No auxiliary servomotor 12, 13 and associated control valve 31 is required with this latter embodiment, since the main control valve serving the master servomotor 4, 5 can be arranged for actuation direct from the control console 32 on the bridge of the vessel or, if so required, with some other emergency system, such as an emergency system of the kind afore-described.

I claim:

1. An actuating system for variation and control of the pitch of a marine propeller having a propeller hub, propeller blades mounted in said hub for rotation about their mounting axes and a hollow rotatable propeller shaft connected to said propeller hub, the system comprising:

a hydraulic servomotor located within said propeller hub and mechanically coupled to said propeller blades for variation of their pitch angle;

a control valve located in said propeller hub for controlling supply of a high pressure fluid to said servomotor, a valve control rod extending axially and being axially displaceable in said hollow propeller shaft and having one end coupled to said control valve for actuating the same;

a high pressure fluid duct extending axially within said hollow propeller shaft and being connected to said control valve for supplying high pressure fluid thereto;

a first stationary high pressure fluid chamber embracing said propeller shaft and being sealed against the external surface of said shaft;

a second stationary high pressure fluid chamber embracing said propeller shaft and being sealed against the external surface of said shaft;

a first radial high pressure fluid channel extending within said shaft between said first high pressure fluid chamber and said axial high pressure fluid duct;

a second radial high pressure fluid channel extending within said shaft between said second high pressure fluid chamber and said axial high pressure fluid duct;

a first high pressure fluid source being alternatively and selectively connectable to either said first high pressure fluid chamber or said second high pressure fluid chamber; and closure means in said first and second radial high pressure fluid channels for alternatively and selectively closing either said first or said second radial high pressure fluid channel to a flow of high pressure fluid therethrough.

2. An actuating system as claimed in claim 1, further comprising a second high pressure fluid source, said first and second high pressure fluid sources being alternatively and selectively connectable to either said first high pressure fluid chamber or said second high pressure fluid chamber.

3. An actuating system as claimed in claim 1, wherein said closure means include check-valve means incorporated in said first and second radial high pressure fluid channels for permitting high pressure fluid to flow solely in one direction from said first and second high pressure fluid chambers respectively, to said axial high pressure fluid duct.

4. An actuating system as claimed in claim 1, wherein said closure means include sealing plugs insertable into said first and second radial high pressure fluid channels.

5. An actuating system as claimed in claim 1, wherein said valve control rod is tubular and constitutes at least part of said axial high pressure fluid duct.

6. An actuating system as claimed in claim 2, wherein said second high pressure fluid source has a smaller volumetric capacity than said first high pressure fluid source.

7. An actuating system as claimed in claim 2, wherein said second high pressure fluid source is fully independent and provided with an individual tank.

* * * * *